US006530961B1

(12) United States Patent
Schrell et al.

(10) Patent No.: US 6,530,961 B1
(45) Date of Patent: Mar. 11, 2003

(54) ALKALINE AQUEOUS SOLUTIONS AND USE THEREOF IN PROCESSES FOR DYEING CELLULOSIC TEXTILE MATERIALS

(75) Inventors: Andreas Schrell, Kriftel (DE); Daniele Negri, Busto Arsizio (IT)

(73) Assignee: DyStar Textilfarben GmbH & Co. Deutschland KG (DE)

( * ) Notice: Subject to any disclaimer, the term of this patent is extended or adjusted under 35 U.S.C. 154(b) by 0 days.

(21) Appl. No.: 09/629,640

(22) Filed: Jul. 31, 2000

Related U.S. Application Data

(63) Continuation-in-part of application No. 09/260,423, filed on Mar. 1, 1999, now abandoned.

(30) Foreign Application Priority Data

Mar. 4, 1998 (DE) ..... 198 09 129
Oct. 29, 1998 (DE) ..... 198 49 898

(51) Int. Cl.[7] ..... C09B 62/04; C09B 62/00; C09B 62/20; C09B 62/343

(52) U.S. Cl. ..... 8/549; 8/549; 8/543; 8/618; 8/918; 252/193; 510/434; 510/509; 423/421; 423/580.1; 423/646; 423/641

(58) Field of Search ..... 8/543, 618, 918, 8/549; 252/193; 423/421, 580.1, 641, 646; 510/435, 509, 434

(56) References Cited

U.S. PATENT DOCUMENTS

| | | | | |
|---|---|---|---|---|
| 3,632,294 A | | 1/1972 | Hoelzle et al. | 8/547 |
| 3,718,641 A | | 2/1973 | Muller et al. | 534/641 |
| 3,859,271 A | | 1/1975 | Sugiyama et al. | 8/549 |
| 3,918,895 A | | 11/1975 | Mizuno | 8/468 |
| 3,993,438 A | | 11/1976 | Fishwick et al. | 8/543 |
| 4,000,966 A | | 1/1977 | Meininger et al. | 8/681 |
| 4,017,256 A | | 4/1977 | Kogel et al. | 8/543 |
| 4,153,413 A | | 5/1979 | Bostock et al. | 8/532 |
| 4,169,705 A | | 10/1979 | Boyd et al. | 8/532 |
| 4,278,433 A | | 7/1981 | Blum et al. | 8/449 |
| 4,370,145 A | | 1/1983 | Schwaiger et al. | 8/549 |
| 4,521,332 A | | 6/1985 | Milora | 134/40 |
| 4,555,348 A | | 11/1985 | Moran | 252/1 |
| 4,705,524 A | | 11/1987 | Hähnke et al. | 8/527 |
| 4,952,688 A | | 8/1990 | Springer | 540/134 |
| 5,028,700 A | | 7/1991 | Schwaiger | 534/618 |
| 5,234,465 A | | 8/1993 | Hähnke et al. | 8/561 |
| 5,352,246 A | | 10/1994 | Hähnke et al. | 8/638 |
| 5,382,262 A | | 1/1995 | Moore | 8/543 |
| 5,603,736 A | | 2/1997 | Moore | 8/618 |
| 5,667,532 A | | 9/1997 | Moore | 8/543 |
| 5,840,084 A | | 11/1998 | Bella et al. | 8/549 |
| 5,869,322 A | | 2/1999 | Sugiura | 435/263 |
| 5,938,796 A | * | 8/1999 | Negri et al. | 8/453 |
| 6,214,059 B1 | * | 4/2001 | Moore | 8/543 |

FOREIGN PATENT DOCUMENTS

| | | |
|---|---|---|
| DE | 196 3 015 | 6/1971 |
| DE | 3542025 | 6/1987 |
| DE | 3727909 | 3/1989 |
| DE | 3843135 | 6/1990 |
| DE | 298 20 204 | 3/1999 |
| EP | 0 283 114 | 9/1988 |
| EP | 0 497 298 | 8/1992 |
| GB | 135 0 291 | 4/1974 |

* cited by examiner

*Primary Examiner*—Yogendra N. Gupta
*Assistant Examiner*—Eisa Elhilo
(74) *Attorney, Agent, or Firm*—Connolly Bove Lodge & Hutz LLP

(57) ABSTRACT

Described are aqueous solutions comprising sodium hydroxide and potassium carbonate in a molar ratio of 1:1.7 to 1:0.5, which are useful for preparing alkaline dyeing liquors, especially padding liquors, of fiber-reactive dyes for producing dyeings on cellulosic textile material.

16 Claims, 1 Drawing Sheet

Figure 1:
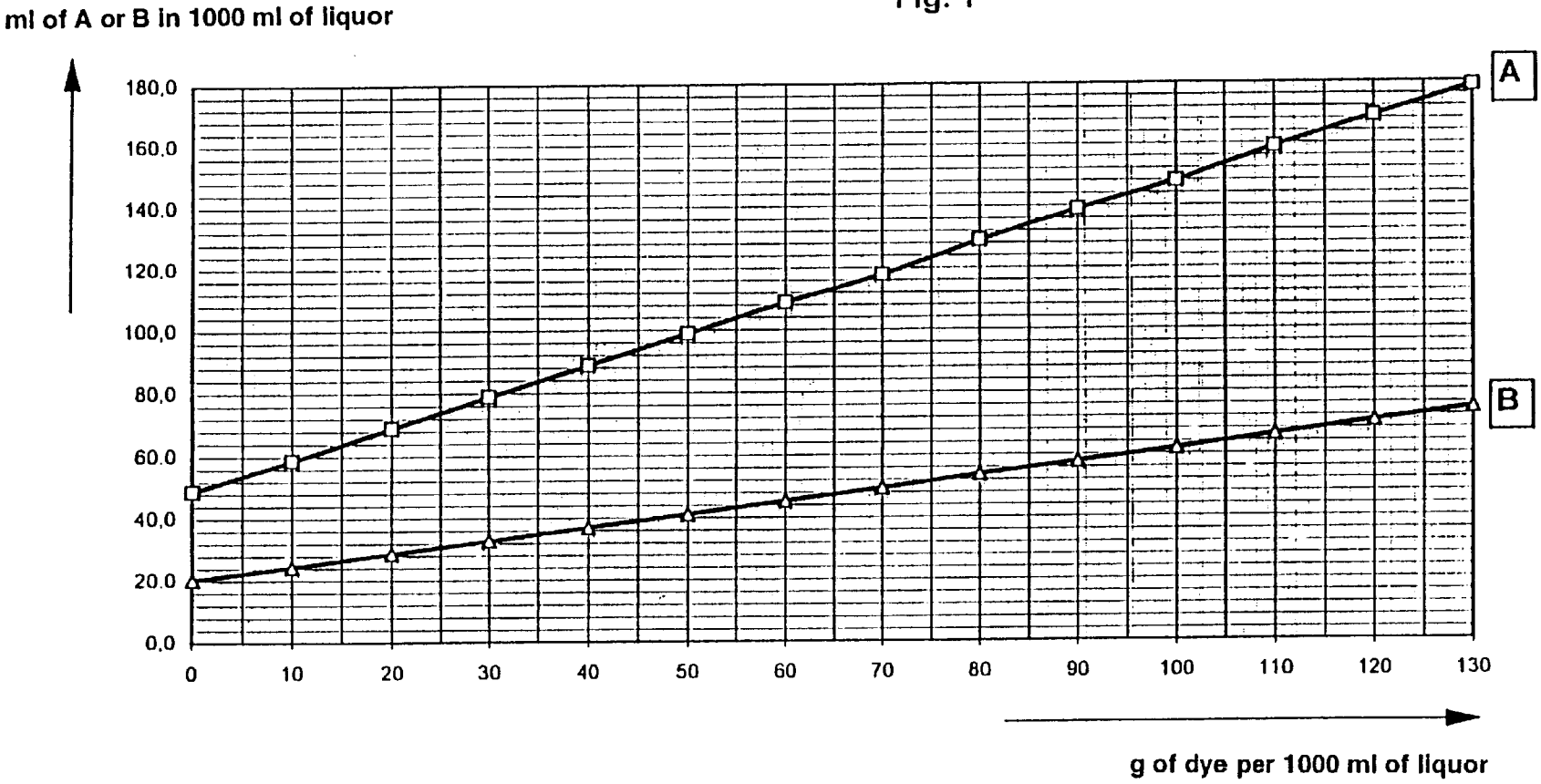

ALKALINE AQUEOUS SOLUTIONS AND USE THEREOF IN PROCESSES FOR DYEING CELLULOSIC TEXTILE MATERIALS

DESCRIPTION OF RELATED CASES

This application is a continuation-in-part of Ser. No. 09/260,423 filed Mar. 1, 1999, which is now abandoned. This application is related to German patent application No. 198 09 129.1 of Mar. 4, 1998 and No. 198 49 898.5 of Oct. 29, 1998 which are both incorporated by reference in its entirety for all useful purposes.

Cellulosic textile materials are dyed by printing, exhaust and padding processes. Fiber-reactive dyes, which are capable of entering a covalent bond with the fiber during the dyeing process, are particularly important dyes for cellulosics, since the dyeings obtainable therewith are notable for good wetfastnesses in particular, which is very difficult or impossible to achieve with non-fiber-reactive dyes. However, the covalent bond between the fiber-reactive dyes and the fiber generally only comes about when the dyeing process is carried out under alkaline conditions. The alkalis used are alkali metal carbonates, alkali metal bicarbonates and alkali metal hydroxides or mixtures thereof plus, in pad dyeing, alkali metal silicates, optionally together with an alkali metal hydroxide or carbonate, the term alkali metal including lithium as well as sodium and potassium. It is mixtures of alkali metal carbonates and alkali metal hydroxides in particular which are highly efficacious and are preferred, although the alkali system used in a particular case is chosen according to the specific fiber-reactive grouping of the dye and the specific dyeing process.

An ultrashort liquor dyeing process, for example the padding process, whereby the treatment liquor is applied to a textile material and the excess liquor on the textile material is then squeezed off, can be carried out according to both a one-stage and a two-stage procedure. The two-stage process procedures, whereby the textile material is initially impregnated with a dye solution to a certain wet pickup, then dried and subsequently overpadded in a further impregnating step with an alkaline electrolyte salt liquor, has the disadvantage of high machine usage and of utilizing electrolyte salts in the second process stage. In contrast, in a one-stage process, the complete treatment liquor, which contains both the fiber-reactive dye and the alkali with or without further auxiliaries, is applied to the textile material in one operation which is followed by the step of fixing the dye on the textile material.

One of these one-stage process procedures is the pad-cold batch process, which is chiefly used for dyes which contain a fiber-reactive group. In this case, the alkalinically binding agents used are frequently alkali metal silicates in the form of waterglass ($Na_2O$: $SiO_2$ in a ratio of 1:2 to 1:3.5), between 60 and 130 g of waterglass of 38° Bé and 6 to 40 ml of approximately 32% strength by weight aqueous sodium hydroxide solution being added per liter of the dyeing liquor, depending on the target depth of shade. Waterglass has the advantage that it has a pH buffering effect and increases the stability of padding liquors of reactive dyes. Another positive effect of using waterglass in the padding process is that the edges of the material to be dyed will have the same depth of shade and hue, since waterglass forms a protective film against the carbon dioxide in the ambient air. Yet, the use of waterglass is not wholly beneficial. Examples of disadvantages are that waterglass tends to crystallize and thus tends to soil the equipment; that it is not possible to neutralize the textile material prior to the washing step; and that the use of steam for fixing the dyes is not always possible; moreover, unattractive hand effects may arise.

The literature describes attempts to remedy such disadvantages. For instance, in U.S. Pat. No. 4,555,348, an aqueous buffer system which has a pH between 11 and 13 and which contains various phosphate salts is added to dyeing liquors. Such an aqueous buffer system is undoubtedly suitable in dyebaths for exhaust processes, but not for dyeing by padding processes. Furthermore, the buffer system has the disadvantage that phosphate salts create environmental problems in water treatment plants.

The art of dyeing by the pad-cold batch process generally features the addition to the dyeing (padding) liquor of a specific amount of sodium hydroxide solution, decided on the basis of the amount of dye present in the padding liquor, and also of about 30 g/l of electrolyte salt, such as sodium chloride or sodium sulfate. However, padding liquor stability is generally unsatisfactory and leads to yield losses in the color strength of the dyeings.

However, the prior art also teaches that sodium carbonate alone or sodium hydroxide/sodium carbonate mixtures can be used in the case of highly fiber-reactive systems, for example dichloroquinoxaline, difluoromonochloropyrimidine and monofluorotriazine dyes. In the case of the pure sodium carbonate method, the lower pH will sometimes lead to uneconomically long fixing times, whereas the sodium hydroxide/sodium carbonate variant will sometimes bring about an increased reactive dye hydrolysis. These systems are less suitable for vinyl sulfone dyes, since the fixing time lengthens significantly and compromises the economics of the dyeing process. In addition, the art as it presents itself at present teaches in relation to the sodium hydroxide/sodium carbonate method that the amount of sodium hydroxide used varies with the dye concentration, while the sodium carbonate is always added as a fixed proportion.

It is an object of the present invention to provide, in the field of dyeing by ultrashort liquor processes, for example by padding processes, especially by the pad-cold batch process, an aqueous alkaline formulation which can be added to the dyeing liquor without creating the disadvantages mentioned.

It has now been found that, especially as replacement for waterglass in ultrashort liquor processes, such as padding processes, an aqueous solution comprising sodium hydroxide and potassium carbonate in a molar ratio of 1:1.7 to 1:0.5, preferably 1:1.5 to 1:1.1, particularly preferably 1:1.2 to 1:0.7, surprisingly has the desired advantageous effect. Moreover, the alkaline formulation of the invention has the particular advantage in use of being meterable. And the use of urea in the dyeing process can be dispensed with. Examples of formulations according to the invention which are suitable for production are aqueous solutions of 39.6 kg of sodium hydroxide and 110 to 163 kg of potassium carbonate in 250 to 1000 liters of solution.

The invention thus provides this solution and also a method of using it in aqueous ultrashort liquors, such as padding liquors, which contain fiber-reactive dyes. They may include customary dyeing auxiliaries, such as an anionic wetting agent.

The solution according to the present invention may also contain potassium hydroxide. It is preferred to replace an amount of from 10 to 40 mole % of sodium hydroxide by potassium hydroxide.

The solution according to the present invention may additionally contain further ingredients like for example sodium chloride, sodium silicate, sodium metasilicate, water glass, Glauber's salt, phosphates like tri-potassium phosphate or tri-sodium phosphate, alkali metal citrates, alkali metal polyacrylates or ethylenediaminetetra-acetic acid (EDTA) and its salts in amounts of less than 5% by weight, preferably less than 2% by weight based on the total weight of the solution. It is, however, particularly preferred if the solution according to the present invention is free of any such further ingredients.

The alkaline formulation of the invention is used according to the invention by mixing an aqueous solution of one or more fiber-reactive dyes, which optionally includes customary dyeing auxiliaries, with the alkaline formulation of the invention (generally 100 liters of an aqueous dye solution comprising about 10 to 12,000 g of dye being admixed with 2 to 17 liters of the alkaline formulation of the invention) and using the resulting alkaline dyeing liquor to impregnate a cellulosic textile material in a conventional manner, for example by spraying or padding, and fixing the dye or dyes under process conditions customary for fiber-reactive dyes.

The invention thus also provides a process for dyeing cellulosic textile material by mixing an aqueous dye solution which per liter contains for example about 0.1 to 120 g of one or more fiber-reactive dyes and optionally customary dyeing auxiliaries, with the alkaline formulation of the invention, for example with 20 to 170 ml, based on 1 liter of the dyeing solution, applying the resulting alkaline dyeing liquor to the cellulosic textile material in an amount of 60 to 100% by weight, based on the weight of the material, for example by spraying or padding, preferably by means of a customary padding process, and fixing the dye or dyes under process conditions customary for fiber-reactive dyes.

Since the alkaline formulation of the invention is easily meterable into the dye solution, even in small amounts and steps, to form the padding liquor, the dyeing procedure is also easily carried out continuously; the alkaline padding liquor can thus be formed continuously, which ensures its stability even in the case of critical dyes.

Dyeing procedures which are usable according to the invention include the usual impregnating (padding) dyeing processes for applying fiber-reactive dyes to and fixing them on cellulosic textile materials, for example the pad-cold batch processes, the pad-dry-pad-steam, pad/air-steam, pad-dry-thermofix, pad-steam and thermosol/pad-steam processes. The dyeings obtainable therein are notable for better washoff, neutralizability (nonexistent in the case of waterglass because treatment in an acidic bath is not possible without $SiO_2$ formation) and better hand.

A preferred ultrashort liquor dyeing procedure is the pad-cold batch process, whereby the alkaline dyeing liquor (dye solution) is pad-mangled onto the fabric and the padded fabric is then rolled onto a batching beam and left at room temperature on the beam for 4 to 24 hours. The fixing phase is followed by a customary washoff process, in which the material may also be acidified.

Dyeing by ultrashort liquor techniques may be performed for example according to the correlations shown in FIG. 1, between the concentration of dye and the amount of alkaline formulation in the padding liquor necessary for effecting fixation. Alkaline formulation A, for example, which is an aqueous solution of 39.6 g of sodium hydroxide and 163 g of potassium carbonate per 1000 ml and of which 49 ml is used for the lowest customary dye concentration, requires that an additional 0.1 to 0.11 ml be used of it per 0.1 part by weight of dye.

Similarly in the case of alkaline formulation B, which is an aqueous solution of 146 g of sodium hydroxide and 390 g of potassium carbonate per 1000 ml, the alkaline dyeing liquor requires an additional 0.04 to 0.045 ml of alkaline solution B per 0.1 part by weight of dye as well as the 20 ml of this alkaline formulation B required for the lowest customary dye concentration.

The alkaline dyeing liquor obtainable by mixing the alkaline formulation of the invention with an aqueous solution of fiber-reactive dyes has high padding liquor stability and can be used in all ultrashort liquor processes, such as padding processes, hitherto customarily utilizing alkali metal silicates (waterglass) as alkali donors and/or pH buffering agents, and replace the latter therein.

By cellulosic textile materials are meant all fiber materials which comprise or consist of cellulosic fibers, for example cotton, jute or linen, and which have been processed into textile structures, especially wovens and knits, and also such materials composed of cellulosic natural fiber materials which have been modified, for example regenerated cellulose, such as filament viscose, and amino-modified cellulose fibers as known for example from U.S. Pat. Nos. 5,507,840; 5,565,007; and 5,529,585; from European Patent Application Publication No. 0 615 311; and from Serman Offenlegungsschrift 19 519 023.

Fiber-reactive dyes are universally and extensively known and described in the literature. As fiber-reactive dyes particular emphasis must be given to those which possess a fiber-reactive radical of the vinyl sulfone series, for example vinylsulfonyl or an ethylsulfonyl which is β-substituted by an alkali-eliminable substituent, such as β-sulfatoethylsulfonyl, β-acetoxyethylsulfonyl, β-chloroethylsulfonyl or β-thiosulfatoethylsulfonyl, also fiber-reactive radicals of the chlorotriazinyl, fluorotriazinyl, dichloroquinoxalinyl, fluoropyrimidinyl and chlorofluoropyrimidinyl series, and also dyes possessing combinations of such fiber-reactive groups.

The examples which follow illustrate the invention. Parts and percentages are by weight, unless otherwise stated. Parts by weight relate to parts by volume as the kilogram to the liter.

EXAMPLE 1

10 parts of a bleached woven cotton fabric are padded at 20° C. to a wet pickup of 70%, based on the weight of the fabric, with an aqueous solution containing (per 1000 parts by volume) 10 parts of the dye of the below-indicated formula (A), which has an electrolyte salt content of about 50%, 10 parts of the dye of the below-indicated formula (B), which has an electrolyte salt content of about 50%, 10 parts of the dye of the below-indicated formula (C), which has an electrolyte salt content of about 50%, and 33 parts of an alkaline formulation containing about 4.87 parts of sodium hydroxide and about 13 parts of potassium carbonate (the dyeing liquor is obtained by addition of 33 parts of a novel alkaline formulation which (per 1000 parts) contains about 331 parts by volume of 32% strength sodium hydroxide solution and about 390 parts of potassium carbonate, to an aqueous solution of the dyes mentioned, which is then made up with water to 1000 parts).

(A)

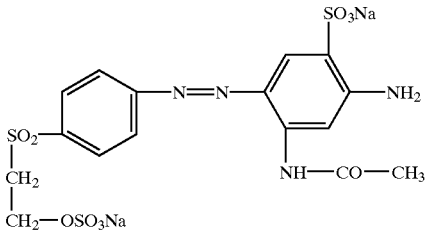

(B)

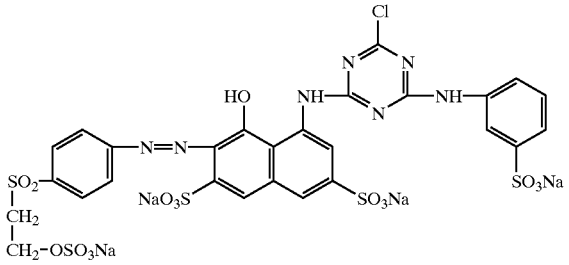

(C)

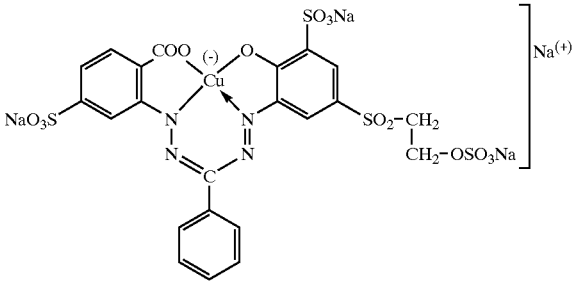

The fabric thus impregnated with the dyeing liquor is plaited down or wound onto a batching beam and left for twelve hours in that state at 20° C. It is then subjected to a washing process customary for fiber-reactive dyes.

A brown dyeing is obtained with the same depth of shade and fastness level as a prior art dyeing (obtained using waterglass and sodium hydroxide solution) and with the fabric edges fully penetrated.

EXAMPLE 2

Example 1 is repeated using an aqueous dyeing liquor which (per 1000 parts by volume) contains 16 parts of the dye of the below-indicated formula (D), which has an electrolyte salt content of about 50%, 12.6 parts of the dye of the below-indicated formula (E), which has an electrolyte salt content of about 50%, 13.3 parts of the dye of the formula (B), which has an electrolyte salt content of about 50%, and 58.5 parts of the dye of the formula (C), which has an electrolyte salt content of about 50%, and also 24 parts of potassium carbonate and 9.1 parts of sodium hydroxide (corresponding to about 62 parts of the novel alkaline formulation which was mentioned in Example 1 and added to the dye solution).

(D)

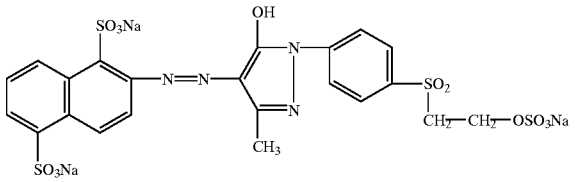

(E)

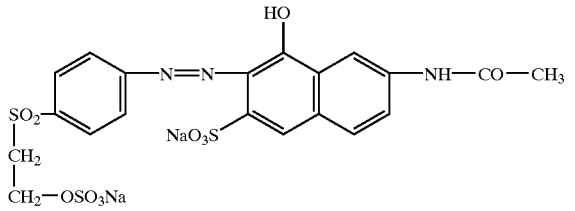

A deep gray dyeing is obtained with the same hue and fastness level as a dyeing produced by the standard processes customary in the prior art, where the dyeing liquor contains waterglass, sodium carbonate and urea.

EXAMPLE 3

A mercerized woven cotton fabric having a weight of about 120 g/m$^2$ is padded at 20° C. in a pad-mangle to a wet pickup of 80%, based on the weight of the fabric, with an aqueous dyeing liquor which (per 1000 parts by volume) contains 50 parts of the dye of the formula (A), which has an electrolyte salt content of about 50%, 6.1 parts of sodium hydroxide and 16.1 parts of potassium carbonate and also a customary anionic wetting agent (obtainable for example by mixing the aqueous solution of dye (A) with 41 parts of the novel alkaline formulation of Example 1 and addition of an anionic wetting agent). The padded fabric is then passed at a speed of 20 m/min into a fixing unit at 120° C. and a relative humidity of 25% and maintained therein at a wet-bulb temperature of 70° C. for 2.5 minutes, fixing the dye on the fabric. The dyed material leaving the fixing unit still has a residual moisture content of 15% and is then subjected to a continuous washoff process customary for reactive dyes and finished.

The yellow dyeing has a very uniform appearance and a smooth surface. The hue is 5% deeper than that of a dyeing produced by a traditional pad-dry-pad steam process using a dye pad, a dryer and a chemical pad comprising 900 ml/l of waterglass and 100 ml/l of 32% strength sodium hydroxide solution as alkali donor.

EXAMPLE 4

A pad-mangle is used to impregnate a woven viscose fiber fabric having a weight of about 100 g/m$^2$ with an aqueous dyeing liquor which (per 1000 parts by volume) contains 50 parts of the dye of the formula (F)

(F)

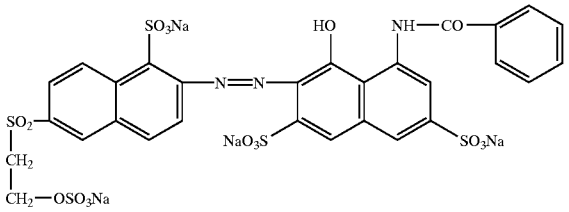

which has an electrolyte salt content of about 50%, 6.1 parts of sodium hydroxide, 16.1 parts of potassium carbonate and 2 parts of a commercially available anionic wetting agent (obtainable similarly to Example 3) to a wet pickup of 90%, based on the weight of the fabric, at 20° C. The fabric thus padded is wound onto a batching beam and left thereon at 20° C. for 12 hours to fix the dye. The dyed fabric is then conventionally rinsed, washed and finished. A strong red dyeing is obtained in the same depth of shade as a dyeing obtained by the pad-dry-pad-steam process.

EXAMPLE 5

10 parts of a bleached linen fabric are padded at 20° C. to a wet pickup of 70%, based on the weight of the fabric, with an aqueous solution which (per 1000 parts by volume) contains 90 parts of a 50% strength powder of the dye of the below-indicated formula (G), which contains electrolyte salt, 16 parts of a 50% strength powder of the dye of the below-indicated formula (H), which contains electrolyte salt, 1.6 parts of a 50% strength powder of the dye of the formula (F), which contains electrolyte salt, and 66 parts of a novel aqueous solution comprising 9.8 parts of sodium hydroxide and 26 parts of potassium carbonate.

(G)

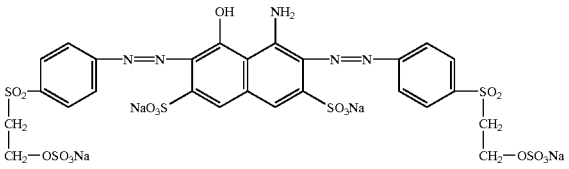

(H)

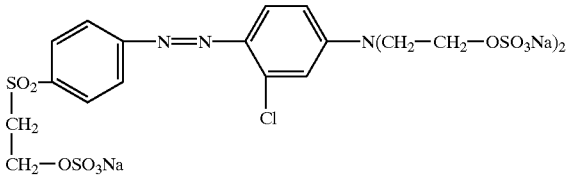

The fabric thus impregnated is then plaited down or wound onto a batching beam and left at 20° C. for twelve hours. The dyeing obtained is then finished in a manner customary for fiber-reactive dyes, by rinsing and washing. A black dyeing is obtained with the same depth of shade and fastness level as a dyeing obtained by a prior art process using waterglass and sodium hydroxide solution.

EXAMPLE 6

10 parts of a bleached cotton twill are padded at 20° C. with a wet pickup of 80%, based on the weight of the fabric, with an aqueous solution which (per 1000 parts by volume) contains 30 parts of a 50% strength powder of the dye of the formula (A), which contains electrolyte salt, 9 parts of a 50% strength powder of the dye of the below-indicated formula (J), which contains electrolyte salt, 10.5 parts of a 50% strength dye of the formula (C), which contains electrolyte salt, 4.5 parts of a 50% strength powder of the dye of the formula (G), which contains electrolyte salt, and 43 parts of a novel aqueous solution comprising 6.2 parts of sodium hydroxide and 16.5 parts of potassium carbonate.

(J)

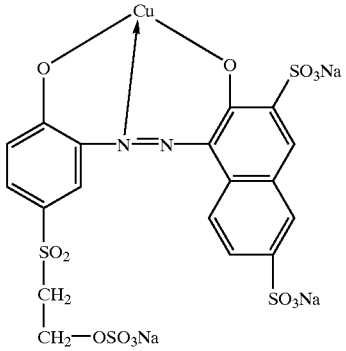

The fabric thus impregnated is then plaited down or wound onto a batching beam and left at 20° C. for twelve hours. The dyeing obtained is then finished in a manner customary for fiber-reactive dyes, by rinsing and washing. A mud-colored dyeing is obtained with the same depth of shade and fastness level as a dyeing obtained by a prior art process using waterglass and sodium hydroxide solution.

EXAMPLE 7

10 parts of a bleached woven cotton fabric are padded at 20° C. to a wet pickup of 70%, based on the weight of the fabric, with an aqueous solution which (per 1000 parts by volume) contains 100 parts of a 50% strength powder of the copper phthalocyanine dye of the below-indicated formula (K), which contains electrolyte salt, and 61 parts of a novel aqueous solution comprising 9.1 parts of sodium hydroxide and 24 parts of potassium carbonate.

(K)

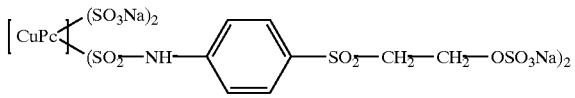

The fabric thus impregnated is then plaited down or wound onto a batching beam and left at 20° C. for twelve hours. The dyeing obtained is then finished in a manner customary for fiber-reactive dyes, by rinsing and washing. A turquoise dyeing is obtained with the same depth of shade and fastness level as a dyeing obtained by a prior art process using waterglass and sodium hydroxide solution.

EXAMPLE 8

10 parts of a bleached and mercerized woven cotton fabric are padded at 20° C. to a wet pickup of 70%, based on the weight of the fabric, with an aqueous solution which (per 1000 parts by volume) contains 3 parts of a 50% strength powder of the dye of the formula (D), which contains electrolyte salt, 3 parts of a 50% strength powder of the dye of the formula (E), which contains electrolyte salt, 3 parts of a 50% strength powder of the dye of the formula (C), which contains electrolyte salt, and 58 parts of a novel aqueous solution comprising 2.3 parts of sodium hydroxide and 9.5 parts of potassium carbonate.

The fabric thus impregnated is then plaited down or wound onto a batching beam and left at 20° C. for twelve hours. The dyeing obtained is then finished in a manner customary for fiber-reactive dyes, by rinsing and washing. A light brown dyeing is obtained with the same depth of shade and fastness level as a dyeing obtained by a prior art process using waterglass and sodium hydroxide solution.

EXAMPLE 9

10 parts of a bleached woven cotton fabric are padded at 20° C. to a wet pickup of 70%, based on the weight of the fabric, with an aqueous solution which (per 1000 parts by volume) contains 80 parts of the commercial dye ®Sumifix Supra Blue B-RF (Colour Index No. 221) and 130 parts of a novel aqueous solution of 5.1 parts of sodium hydroxide and 21 parts of potassium carbonate.

The fabric thus impregnated is then plaited down or wound onto a batching beam and left at 20° C. for twelve hours. The dyeing obtained is then finished in a manner customary for fiber-reactive dyes, by rinsing and washing. A deep blue dyeing is obtained with the same depth of shade and fastness level as a dyeing obtained by a prior art process using waterglass and sodium hydroxide solution.

EXAMPLE 10

10 parts of a bleached woven cotton fabric are padded at 20° C. to a wet pickup of 70%, based on the weight of the fabric, with an aqueous solution which (per 1000 parts by volume) contains 110 parts of a 50% strength powder of the dye of the formula (G), which contains electrolyte salt, 40 parts of a 50% strength powder of the dye of the below-indicated formula (L), which contains electrolyte, and 90 parts of a novel aqueous solution of 13 parts of sodium hydroxide and 35 parts of potassium carbonate.

(L)

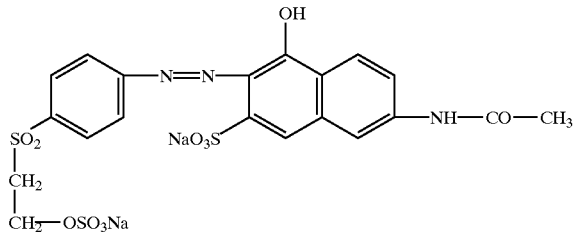

The fabric thus impregnated is then plaited down or wound onto a batching beam and left at 20° C. for twelve hours. The dyeing obtained is then finished in a manner customary for fiber-reactive dyes, by rinsing and washing. A jet black dyeing is obtained with the same depth of shade and fastness level as a dyeing obtained by a prior art process using waterglass and sodium hydroxide solution.

COMPARISON EXAMPLE A

Alkaline Solutions are produced as follows:

Alkaline Solution No. 1A:

consisting of 100 g of sodium chloride, 150 g of sodium carbonate, 50 g of potassium carbonate, 10 g of water glass of 38° Bé, 27 g of an 32.5% b.w. sodium hydroxide solution and 700 g of water (U.S. Pat. No. 3,918,895, Example A)

After preparation of Solution 1A, it is allowed to stand for 12 hours at a temperature of 20° C. After said time a precipitate is formed from the solution. Consequently, Solution 1A is not stable for storage.

Alkaline Solution No. 1B:

(consisting of 150 g of sodium carbonate, 50 g of potassium carbonate, 27 g of an 32.5% b.w. sodium hydroxide solution and 700 g of water (Solution 1B is similiar to Solution 1A, but differs from the latter in the absence of sodium chloride and water glass)

After preparation of Solution 1B, it is allowed to stand for 12 hours at a temperature of 20° C. Although the electrolyte salt sodium chloride is not present, a precipitate is formed from the solution. Consequently, Solution 1B is not stable for storage as well.

Alkaline Solution No. 2A:

consisting of 100 g of sodium chloride, 100 g of sodium carbonate, 100 g of potassium carbonate, 80 g of an 32.5% b.w. sodium hydroxide solution and water up to a total volume of 1 liter.

(U.S. Pat. No. 5,352,246, Example A)

After preparation of Solution 2A, it is allowed to stand for 12 hours at a temperature of 20° C. After said time a precipitate is formed from the solution. Consequently, Solution 2A is not stable for storage.

Alkaline Solution No. 2B:

consisting of 100 g of sodium carbonate, 100 g of potassium carbonate, 80 g of an 32.5% b.w. sodium hydroxide solution and water up to a total volume of 1 liter.

(Solution 2B is similiar to Solution 2A, but differs from the latter in the absence of sodium chloride)

After preparation of Solution 2B, it is allowed to stand for 12 hours at a temperature of 20° C. Although the electrolyte salt sodium chloride was not present, a precipitate is formed from the solution. Consequently, Solution 2B is not stable for storage as well.

Alkaline Solution No. 3A:

consisting of 62.5 g of an aqueous 47% b.w. potassium carbonate solution, 14.5 g of an 50% b.w. sodium hydroxide solution, 21.65 g of an aqueous 40% b.w. solution of the tetrasodium salt of ethylene-diamine-tetraacetic acid (EDTA) and 1.35 g of water (U.S. Pat. No. 5,840,084, Example 1D; col. 10/11)

Solution 3A remaines stable after being allowed to stand for 12 hours at a temperature of 20° C.

Alkaline Solution No. 3B:

consisting of 62.5 g of an aqueous 47% b.w. potassium carbonate solution, 14.5 9 of an 50% b.w. sodium hydroxide solution and 1.35 g of water (Solution 3B is similiar to Solution 3A, but does not contain EDTA)

Solution 3B remaines stable after being allowed to stand for 12 hours at a temperature of 20° C. as well.

Alkaline Solution No. 4:

consisting of 391 g of potassium carbonate, 336 ml of an 32.5% b.w. sodium hydroxide solution and 663 ml of water (present invention)

Solution No. 4 remaines stable after being allowed to stand for 12 hours at a temperature of 20° C.

Results obtained:

It can be seen from the above that the Alkaline Solutions Nos. 1A and 2A according to prior art are not stable to storage, whereas the inventive Alkaline Solutions Nos. 1B and 2B are stable to storage. Stability to storage, however, is an basic requirement for Alkaline Solutions to be used in dyeing processes. With respect to Alkaline Solutions Nos. 3A and 3B, it can be seen that EDTA has no influence on the storage stability. Alkaline Solution No. 4 according to the present invention is stable to storage.

COMPARISON EXAMPLE B

The following dyestuffs were used

Dye No. I:

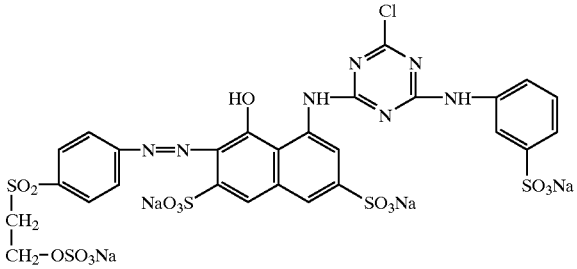

Dye No. II:

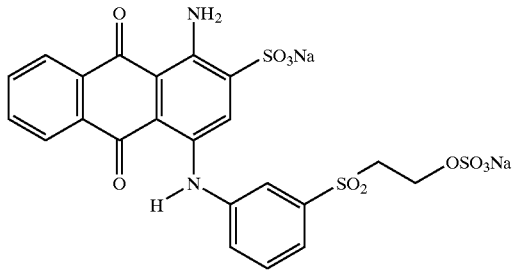

Dye No. III:

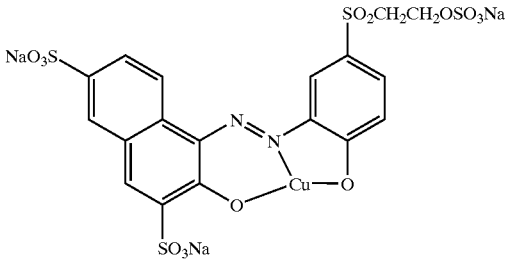

Dyeing Processes:

The prior art composition of Table Example 1D of U.S. Pat. No. 5,840,084, corresponding to Alkaline Solution No. 3A of Comparison Example A above, differs from the inventive Alkaline Solution No. 3B only in the presence of the tetrasodium salt of the ethylene-diamine-tetraacetic acid (EDTA). In order to test the influence of EDTA on the quality and color depth of dyeings obtained when using an alkaline solution as a fixation agent in a cold-pad batch dyeing process, alkaline dye solutions (padding liquors) are prepared containing the alkaline solution according to the present invention on the one hand in accordance with the process claimed in said present invention and containing, on the other hand, said alkaline solution and EDTA according to U.S. Pat. No. 5,840,084.

The following alkaline dye solutions (dyeing liquors) are prepared:

Liquor No. A-I:

containing, in 1liter 30 g of a dye containing 50% of Dye No. I and 32 g of Alkaline Solution No. 4 (according to the present invention)

Liquor No. B-I:

containing, in 1 liter 30 g of a dye containing 50% of Dye No. I, 32 g of Alkaline Solution No. 4 and 21.65 g of a 40% b.w. solution of EDTA (corresponding to U.S. Pat. No. 5,840,084, Example 1D)

Liquor No. A-II:

containing, in 1 liter 30 g of a dye containing 50% of Dye No. II and 32 g of Alkaline Solution No. 4 (according to the present invention)

Liquor No. B-II:

containing, in 1 liter 30 g of a dye containing 50% of Dye No. 11 and 32 g of Alkaline Solution No.4 and 21.65 g of a 40% b.w. solution of EDTA (corresponding to U.S. Pat. No. 5,840,084, Example 1D)

Liquor No. A-III:

containing, in 1 liter 10 g of a dye containing 50% of Dye No. II and 20 g of Alkaline Solution No. 4 (according to the present invention)

Liquor No. B-III:

containing, in 1 liter 10 g of a dye containing 50% of Dye No. III and 20 g of Alkaline Solution No.4 and 21.65 g of a 40% b.w. solution of EDTA (corresponding to U.S. Pat. No. 5,840,084, Example 1D)

Liquors A are prepared by dissolving the dye in about 200 g of distilled water of 50° C., cooling the dye solution to 20° C., adding the Alkaline Solution A under stirring and filling up with distilled water to a volume of 1 liter.

Liquors B are prepared by dissolving the dye in about 200 g of distilled water of 50° C., cooling the dye solution to 20° C., adding, under stirring, the Alkaline Solution A and the EDTA-solution and filling up with distilled water to a volume of 1 liter.

Preparation of the Dyeings A and B:

In each case, immediately after the preparation of the dye liquor, a fabric of mercerized cotton is padded with a liquor pick-up of 90% by weight, calculated on the weight of the fabric, with an dye liquor having a temperature of 25° C. The padded fabric is rolled-up on a batching roller, wrapped in a foil and allowed to stand (dwell) at a temperature of 20° C. for 12 hours.

The dyeing obtained is then after-treated in the usual manner by rinsing with cold and warm water, then moving in an aqueous bath containing 0.5 g acetic acid per liter for 5 minutes at 20° C., rinsing with cold and hot water, moving in an aqueous bath containing 0.5 g per liter of a commercial neutral washing agent for 15 minutes at boiling temperature, rinsing again with hot and with cold water, centrifuging and drying.

Results Obtained:

The process for the preparation of Dyeings A-I, A-II and A-III employing the Alkaline Solution No. 4 alone, i.e. in the absence of any EDTA, according to the present invention, yields dyeings having a very strong color depth which are unexpectedly extensively stronger than the prior art dyeings (Dyeings B-I, B-II and B-III) obtained according to the teaching of U.S. Pat. No. 5,840,084 involving the use of EDTA, and thus highly superior to the prior art samples. Consequently, the process according to the present invention, as well as the alkaline solutions according to the present invention are highly superior to the prior art process and the alkaline solutions containing EDTA as a so-called auxiliary agent, disclosed in U.S. Pat. No. 5,840,084. This superior result could not be expected from the teaching of the U.S. Pat. No. 5,840,084 by a skilled person.

What is claimed is:

1. An aqueous solution consisting essentially of (A) sodium hydroxide and potassium hydroxide, (B) potassium carbonate, and the ratio of (A) to (B) is in a molar ratio of 1:1.7 to 1:0.5.

2. An aqueous solution consisting essentially of (A) sodium hydroxide, (B) potassium carbonate, and the ratio of (A) to (B) is in a molar ratio of 1:1.7 to 1:0.5.

3. The aqueous solution as claimed in claim 1, wherein said ratio of (A) to (B) is in a molar ratio of 1:1.5 to 1:1.1 and wherein the solution is alkaline form.

4. The aqueous solution as claimed in claim 2, wherein said ratio of (A) to (B) is in a molar ratio of 1:1.5 to 1:1.1 and wherein the solution is alkaline form.

5. The aqueous solution as claimed in claim 1, wherein said ratio of (A) to (B) is in a molar ratio of 1:1.2 to 1:0.7 and wherein the solution is alkaline form.

6. The aqueous solution as claimed in claim 2, wherein said ratio of (A) to (B) is in a molar ratio of 1:1.2 to 1:0.7 and wherein the solution is alkaline form.

7. The aqueous solution as claimed in claim 2, wherein 10 to 40% of the sodium hydroxide is replaced with potassium hydroxide.

8. A process for dyeing cellulosic textile materials, which comprises mixing the aqueous solution as claimed in claim 7 in an alkaline form with an aqueous solution of one or more fiber-reactive dyes to form a resulting alkaline dyeing liquor, impregnating the resulting alkaline dyeing liquor to the cellulosic textile material and fixing the fiber-reactive dye or dyes by means of a dyeing and fixing process selected from the group consisting of pad-cold batch, a pad-dry-pad, steam pad-dry-thermofix, pad-steam, thermosol/pad-steam and pad/air-steam.

9. A process for dyeing cellulosic textile materials, which comprises mixing the aqueous solution as claimed in claim 8 in an alkaline form with an aqueous solution of one or more fiber-reactive dyes to form a resulting alkaline dyeing liquor, impregnating the resulting alkaline dyeing liquor to the cellulosic textile material and fixing the fiber-reactive dye or dyes by means of a dyeing and fixing process selected from the group consisting of pad-cold batch, a pad-dry-pad, steam pad-dry-thermofix, pad-steam, thermosol/pad-steam and a pad/air-steam.

10. The process as claimed in claim 8, wherein the process is a pad-cold batch, pad-dry-pad steam and pad/air-steam process.

11. The process as claimed in claim 9, wherein the process is a pad-cold batch, pad-dry-pad steam, and pad/air steam process.

12. A process for dyeing cellulosic textile materials, which comprises the steps of:

mixing the aqueous solution as claimed in claim 11 in an alkaline form with an aqueous solution of one or more fiber-reactive dyes thus forming an alkaline dyeing liquor; applying said dyeing liquor on the cellulosic textile material and fixing the fiber-reactive dye or dyes by means of a dyeing and fixing process selected from the group consisting of a pad-cold batch, a pad-dry-pad steam, a pad/air-steam, a pad-dry-thermofix, a pad-steam and a thermosol/pad-steam.

13. A process for dyeing cellulosic textile materials, which comprises the steps of:

mixing the aqueous solution as claimed in claim 12 in an alkaline form with an aqueous solution of one or more fiber-reactive dyes thus forming an alkaline dyeing liquor; applying said dyeing liquor on the cellulosic textile material and fixing the fiber-reactive dye or dyes by means of a dyeing and fixing process selected from the group consisting of a pad-cold batch, a pad-dry-pad steam, a pad/air-steam, a pad-dry-thermofix, a pad-steam and a thermosol/pad steam.

14. A process for dyeing cellulosic textile materials, which comprises mixing the aqueous alkaline formulation as claimed in claim 1 with an aqueous solution of one or more fiber-reactive dyes, impregnating the resulting alkaline dyeing liquor to the cellulosic textile material and fixing the dye or dyes.

15. The process of claim 14, wherein the process is a pad-cold batch, pad-dry-pad steam, pad/air steam, pad-dry-thermofix, pad-steam or thermosol/pad-steam process.

16. The aqueous solution as claimed in claim 2, which consists of sodium hydroxide and potassium carbonate in a molar ratio of 1:1.7 to 1:0.5.

* * * * *

UNITED STATES PATENT AND TRADEMARK OFFICE

CERTIFICATE OF CORRECTION

PATENT NO. : 6,530,961 B1
DATED : March 11, 2003
INVENTOR(S) : Andreas Schrell et al.

It is certified that error appears in the above-identified patent and that said Letters Patent is hereby corrected as shown below:

Column 13,
Line 46, "claim 7" should read -- claim 1 --.
Lines 51-52, "a pad-dry-pad, steam pad-dry-thermofix," should read -- a pad-dry-pad steam, pad-dry-thermofix --.

Column 14,
Lines 8-9, "a pad-dry-pad, steam pad-dry-thermofix," should read -- a pad-dry-pad steam, pad-dry-thermofix --.

Signed and Sealed this

Second Day of September, 2003

JAMES E. ROGAN
*Director of the United States Patent and Trademark Office*